United States Patent [19]

Blangetti et al.

[11] Patent Number: 4,967,833

[45] Date of Patent: Nov. 6, 1990

[54] STEAM CONDENSER

[75] Inventors: Francisco Blangetti, Wettingen; Christian Stucki, Zürich, both of Switzerland; Marc-Aurel Voth, Kadelburg, Fed. Rep. of Germany

[73] Assignee: ASEA Brown Boveri Ltd., Baden, Switzerland

[21] Appl. No.: 297,388

[22] Filed: Jan. 17, 1989

[30] Foreign Application Priority Data

Jan. 22, 1988 [CH] Switzerland ..... 230/88

[51] Int. Cl.[5] ..... F28B 9/10

[52] U.S. Cl. ..... 165/114; 165/112

[58] Field of Search ..... 165/112–114

[56] References Cited

U.S. PATENT DOCUMENTS

| | | | |
|---|---|---|---|
| 1,764,716 | 6/1930 | Ehrhart | 165/112 |
| 1,796,708 | 3/1931 | Grace | 165/114 X |
| 2,663,547 | 12/1953 | Evans, Jr. et al. | 165/114 |
| 2,869,833 | 1/1959 | Aronson et al. | 165/114 X |
| 4,219,077 | 8/1980 | Furukawa et al. | 165/114 |
| 4,226,283 | 10/1980 | Furukawa et al. | 165/114 |
| 4,461,346 | 7/1984 | Hoshino et al. | 165/114 |

FOREIGN PATENT DOCUMENTS

| | | |
|---|---|---|
| 0049116 | 4/1982 | European Pat. Off. . |
| 1948073 | 3/1971 | Fed. Rep. of Germany . |
| 1579333 | 8/1969 | France . |
| 423819 | 5/1967 | Switzerland . |

*Primary Examiner*—Martin P. Schwadron
*Assistant Examiner*—Allen J. Flanigan
*Attorney, Agent, or Firm*—Burns, Doane, Swecker & Mathis

[57] ABSTRACT

In a steam condenser in which the steam is condensed on tubes which are grouped together in separate nests (2) and through which cooling water flows, the tubes, arranged in rows, of a nest enclosing a hollow space (13), a cooler (14) for the non-condensable gases in arranged in the hollow space. Two nests (2) are provided which are at a distance from one another and to which steam is admitted over their entire periphery, the nest form, irrespective of the external form of the condenser, being selected in such a way that first of all a convergent flow channel (15)—accelerating the steam—and then adjoining it a divergent retaining part (16)—deflecting the steam—are formed between the nests (2) on the one side and also between one nest each and the condenser wall. The cooler (14) for the non-condensable gases is located inside a nest in the plane in which, outside the nest, the convergent steam channel merges into the divergent part.

5 Claims, 3 Drawing Sheets

STEAM CONDENSER

DESCRIPTION

1 Field of the Invention

The invention relates to a steam condenser in which the steam is condensed on tubes which are grouped together in separate nests and through which cooling water flows, the tubes, arranged in rows, of a nest encircling a hollow space in which a cooler for the non-condensable gases is arranged.

2. Prior Art

Swiss Patent Specification No. 423,819 discloses a steam condenser of this type. In this prior art, the condenser tubes, in a condenser housing, are arranged in a plurality of so-called sectional nests. The steam flows through an exhaust-steam connecting piece into the condenser housing and is distributed in the space through flow channels. These narrow in the general direction of the flow in such a way that the flow velocity of the steam in these channels remains at least roughly constant. The free inflow of the steam to the external tubes of the sectional nests is ensured. The steam then flows through the nests with low resistance, brought about by the small depth of the tube rows. So that the constant velocity condition for the steam can be fulfilled, the sectional nests in the condenser are arranged next to one another in such a way that flow channels develop between them which in sectional view appear in the same order of magnitude as the sectional nests themselves. Furthermore, the tubes in the rows following one behind the other form a self-contained wall, which is preferably of the same thickness throughout.

This known condenser has the advantage that, by the open arrangement of the sectional nests, all peripheral tubes of a sectional nest can be effectively fed with steam without noticeable pressure loss. On the other hand, the requirement for at least approximately the same "wall thickness" of the sectional nest of tubes around the hollow space necessitates a relatively large overall height of the sectional nest. From this results the excellent suitability of this sectional-nest design for large condensers in which a plurality of sectional nests are arranged so as to stand next to one another. This known solution is less suitable for steam condensers of small power station installations of up to 100MW, in chemical engineering or in process technology, in which condensers the steam quantities arising are lower.

For reasons of cost, the surface condensers, in the last-mentioned installations, are chiefly constructed in round form. These designs are normally realised with steam flushing of the nest on one side through a V-section arranged in the condenser centre. The flows are arranged in the vertical direction from the centre outwards with the air coolers on both sides of the shell. The typical weak points of these designs are the lack of condensing output from the lower tube sections and also persistent undercooling of the condensate and high oxygen content in the condensate as well as poor partial-load behaviour.

SUMMARY OF THE INVENTION

The object of the invention is therefore to create a condenser of the type mentioned at the beginning of any size and preferably of simple external form, which condenser has the advantages of the abovementioned sectional-nest designs.

This is achieved according to the invention when two nests are provided which are at a distance from one another and to which steam is admitted over their entire periphery, the nest form, irrespective of the external form of the condenser, being selected in such a way that first of all a convergent flow channel—accelerating the steam—and then adjoining it a divergent retaining part—deflecting the steam—are formed between the nests on the one side and also between one nest each and the condenser wall, and when the cooler for the non-condensable gases inside a nest is located in the plane in which, outside the nest, the converging steam channel merges into the divergent part.

The advantage of the invention can be seen from the fact that, as a result of the reduction in pressure, deliberately realised, in the lanes through which steam flows at the level of the air cooler on both sides of the respective nest, the pressure drop on the steam side over the nest is roughly constant so that a homogeneous pressure gradient results in the direction of the cooler. With this measure, effective flushing with steam through the nest is achieved. After passing through the maximum velocity, the steam in the lanes is decelerated down to zero with a recovery of pressure at the level of the condensate receiver. This brings about an increase in the saturation temperature and thus regeneration of the condensate under cooling which has taken place and of the oxygen concentration in the condensate. Owing to the fact that the retention takes place only at the lower end of the nest on account of the flow passage selected, accumulations of non-condensable gases in the nest lanes themselves are also avoided.

In a double-flow cooling-water passage, it is convenient when the cooling water is first of all admitted to the lower tubes of each nest, the cooler for the non-condensable gases preferably being arranged inside the lower tube nest, to which water is admitted first. This assists the regenerative properties of the nest configuration.

It is useful when the tubes of the cooler in the hollow space of the nest are provided with a cover plate which in addition is designed as a closed suction channel which communicates with the cooler zone via orifices. This multifunctional cover plate protects the cooler tubes from the condensate trickling down.

Furthermore, in double-flow or multiflow arrangements, it is essential to extract the air-steam mixture laterally from the condenser. For this purpose, it is advisable for the steam-air mixture flowing from the cooler into the suction channel to be drawn off from the channel via at least one suction line penetrating through the nest, for which purpose, at the dividing plane between the two flows, one or two tube rows respectively are missing in the otherwise closed shell and are replaced by baffle-like steam barriers. These steam barriers prevent the steam from flowing in directly to the air coolers.

Swiss Patent Specification No. 423,819 already mentioned certainly discloses similar shielding. However, this is an enclosed casing which represents a flow obstacle in the vertical plane, in particular for the condensate dripping down.

BRIEF DESCRIPTION OF THE DRAWING

With reference to a power station condenser, an exemplary embodiment of the invention is schematically shown in the drawing, in which.

Figure 1:
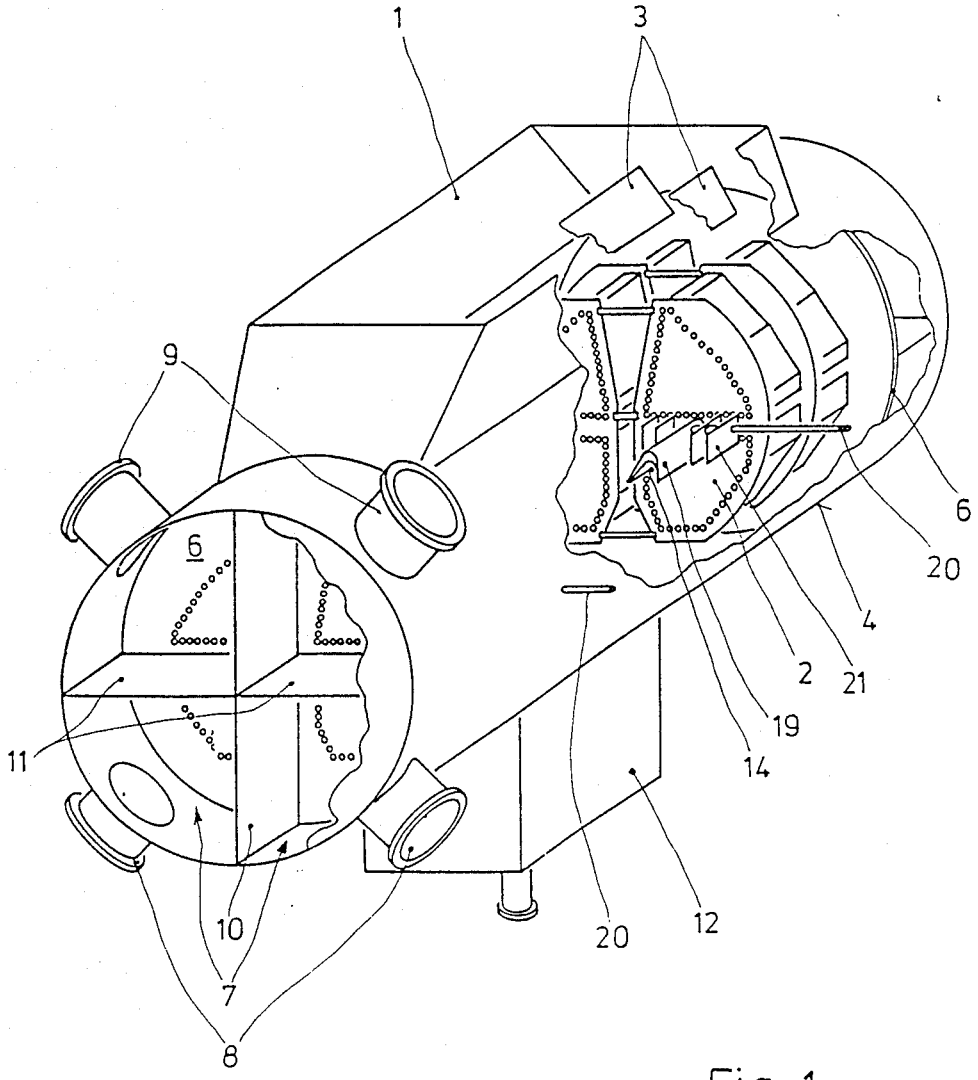
FIG. 1 shows a perspective view of the condenser.

The heat exchanger shown is a surface condenser of a round type of construction, as is suitable for the so-called under floor arrangement. As a rule, condensers of this type have heat-exchange areas of between 500 and 2500 $m^2$.

METHOD OF EMBODYING THE INVENTION

The steam flows into the elongated condenser neck 1 via an exhaust-steam connecting piece (not shown) with which the condenser hangs on the turbine. A flow zone which is as homogeneous and effective as possible is produced in the condenser neck 1 in order to properly flush the nests 2 with steam over their entire length, which nests 2 are arranged downstream. For the purpose of properly distributing the steam, guide vanes 3 can be provided in the condenser neck 1.

The condensation space inside the cylindrical condenser shell contains two separate nests 2. The aim of this, inter alia, is to make possible a partial shut-off on the cooling-water side even during operation of the installation, for example for the purpose of inspecting the shut-off nest on the cooling-water side. The independent admission of cooling water is evidenced by the fact that, according to FIG. 1, the water chambers are subdivided into two compartments by a vertical dividing wall 10.

The nests consist of a number of tubes 5 which are each fixed at their two ends in tube plates 6. The water chambers 7 are each arranged on the other side of the tube plates. In the example shown, a double-flow cooling-water passage has been selected, which means that the inlet and outlet water chambers are located on one side of the condenser and the return chambers are located on its other side. In order to keep down the condensate loading on the lower nest section, the lower nest section is selected for the first flow, ie. the cooling water is introduced there. In FIG. 1, therefore, the lower water-chamber connections form the inlet pipes 8 and the upper water-chamber connections form the outlet pipes 9. Horizontal dividing walls 11 subdivide each of the chambers into inlet and outlet chambers respectively.

The condensate flowing off from the nests 2 is collected in a condensate receiver 12 and passes from there into the water/steam circuit (not shown).

Formed inside each nest 2 is a hollow space 13 in which the steam, enriched with non-condensable gases—termed air hereinafter—collects. An air cooler 14 is accommodated in this hollow space 13. The steam-air mixture flows through this air cooler, the largest proportion of the steam condensing. The rest of the mixture is drawn off at the cold end.

To this extent condensers are known. It should be noted here that the air cooler located inside the tube nest has the effect of accelerating the steam-gas mixture inside the condenser nest. This improves the conditions inasmuch as no low velocities of flow prevail which could impair the heat transfer.

Starting from the predetermined external form of the condenser—in the present case a cylinder—the form of the two nests 2 is adapted in such a way that the following goals are achieved:

good utilisation of the temperature gradient small pressure drop in the tube nest despite high packing density of the tubing no stagnating accummulations of air in the steam lanes and the nests no undercooling of the condensate good degassing of the condensate.

For this purpose, the nests are configured in such a way that steam effectively flows against all tubes at the periphery without noticeable pressure loss. In order to now ensure homogeneous, proper steam flow and in particular to eliminate retention inside the nest, the existing flow paths between the two nests 2 on the one side and also between one nest each and its adjacent condenser wall are designed as follows:

First of all it is assumed that a fairly homogeneous flow zone prevails over the entire outflow cross-section of the condenser bottom 1, which can be achieved, inter alia, by arranging the guide vanes 3. In this arrangement, the latter are set in such a way that the trailing flow of the steam does not induce any vibrations in the tubes to which steam is admitted first.

The major first part 15 of the flow path between the start and end of the nest is designed so as to be convergent. The flowing steam undergoes a spatial acceleration therein with a corresponding reduction in the static pressure. This runs roughly homogeneously on both sides of the nest. At the narrowing in the channel to be made on both sides of the nest, the fact has to be taken into account here that, as a result of the condensation, the mass flow of the steam becomes increasingly smaller.

After the maximum predetermined velocity has been reached, the steam, according to the invention, is at this point to be decelerated down to zero velocity with a simultaneous recovery of pressure. This is achieved by the second part 16 of the steam lane being constructed so as to be divergent. Here, too, it has to be noted that the widening in the channel as a result of the continuing decrease in the mass flow need not be visually discernable. The determining factor is that the residual steam flowing towards the condenser bottom produces a dynamic pressure there. The steam is thereby deflected and thus also supplies the lower sections of the nests. The increase in temperature caused by the dynamic pressure benefits the condensate, flowing off from tube to tube, by the condensate being reheated if it has cooled down below the saturation temperature. This ensures two advantages: there are no thermodynamic losses on account of undercooling of the condensate, and the oxygen content of the condensate is reduced to a minimum.

It can be recognised from all this that no numerical values can be given to specify the idea behind the invention, since they are dependent upon far too many parameters. What is important is that the nest periphery is to be fed uniformly with steam.

Figure 2:
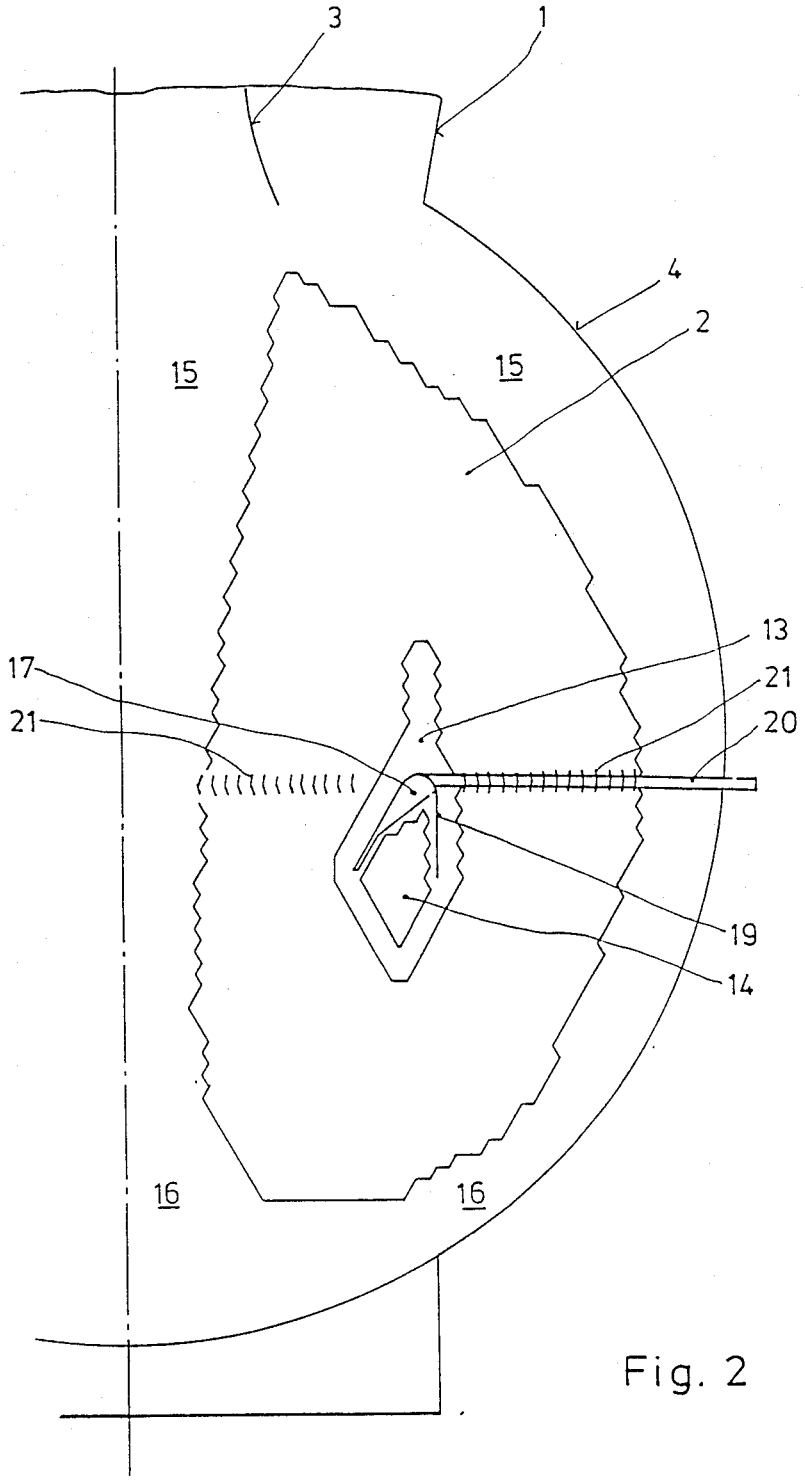
FIG. 2 shows a partial cross-section through the condenser.

As a further measure serving to admit steam uniformly to the nest, the air cooler 14 is arranged inside the nest at that level at which, on both sides of the nests, the pressure variation in the lane through which steam flows passes through a relative minimum. In the example shown, the air cooler, according to FIG. 2, is thus located in the nest centre, and in fact in the first flow directly below the dividing plane of the two flows. The nest is configured in such a way that the suction of steam into the hollow space 13—taking into account the effective pressure at the tube periphery and on the basis of the different tube-row thickness—acts homogeneously in the radial direction over all adjoining tubes in the hollow space 13. This results in a homogeneous pressure gradient and thus a well-defined flow direction of the steam and the non-condensable gases in the direction of the air cooler.

In operation, the steam condenses on the tubes 5 and the condensate drips towards the condenser bottom. This dripping takes place inside the nests, the condensate coming into contact with steam of increasing pressure.

Figure 3:
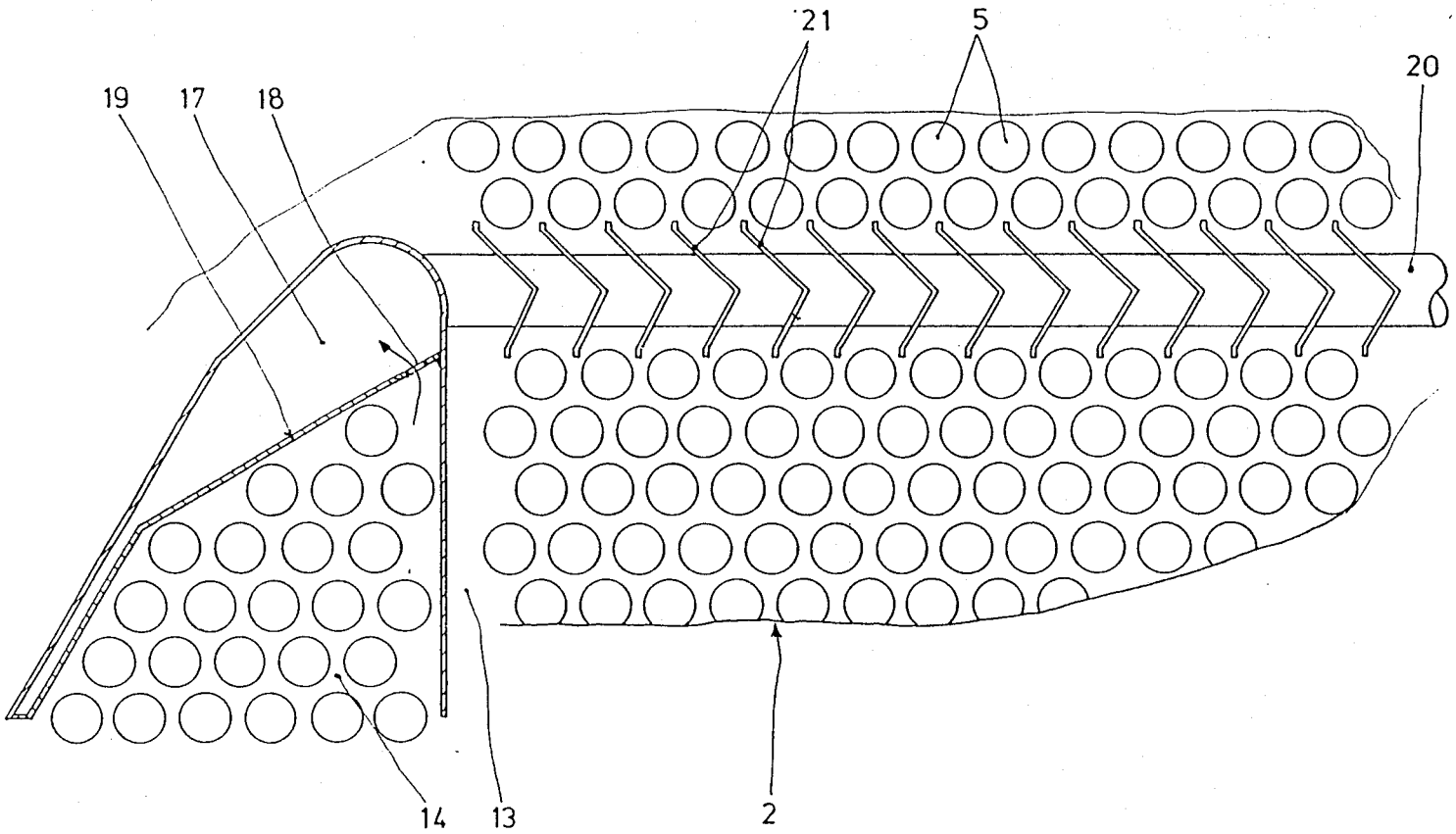
FIG. 3 shows the detail A from FIG. 2 to an enlarged scale.

The air cooler 14 has the task of removing the non-condensable gases from the condenser. During this operation, the steam losses are kept as low as possible. This is achieved by the steam/air mixture being accelerated in the direction of suction channel 17. The high velocity results in good heat transfer, which leads to substantial condensation of the residual steam. For the purpose of accelerating the mixture, the cross-section is dimensioned so as to become increasingly smaller in the flow direction, as revealed in FIG. 3. The air is drawn off into the channel 17 via orifices 18. Several of these orifices are distributed over the entire condenser length and cause the suction effect to be homogeneous in all compartments of the condenser.

A part of the wall of the suction channel 17 is at the same time designed as a coverplate 19. This plate is turned over the tubes of the cooler and protects the latter from the steam and condensate flow passing from top to bottom. Thus the inlet direction of the mixture to be cooled is also predetermined, namely from the bottom upwards towards the orifices 18.

In order to conduct the air from the suction channel 17 to the suction apparatus (not shown), a corresponding number of tubes 5 are omitted from the nests 2. In the process, depending on the size and staggering of the tubes 5, either one or two rows of tubes are left out. A plurality of suction lines 20 penetrating through the nest are led out through this gap. In the double-flow arrangement shown, this gap is provided at the dividing plane between the two flows. Consequently no space is lost, since assembly area has to be provided anyway for the cooling-water-side dividing walls 11 in the water chambers.

The free space resulting from the omission of the tubes is fitted with steam barriers 21. These have the primary aim of preventing a steam bypass. They are longitudinally directed, baffle-like plates which have passage openings (not shown) for the suction lines 20. These baffles are designed in such a way that they do not prevent the vertical exchange of steam or condensate. In the direction of the steam lane/cooler, they form a flow obstacle which should have the same pressure loss as the original tubing.

The invention is of course not restricted to the example shown and described. Thus in a deviation from the double-flow arrangement shown, a single-flow arrangement could also be constructed. In this case, it is convenient if the non-condensable gases are extracted from the condenser in the longitudinal direction instead of transversely through the nests. The suction line in this case penetrates through one of the tube plates and the corresponding water chamber.

We claim:

1. Steam condenser in which the steam is condensed on tubes which are grouped together in separate nests and through which cooling water flows, the tubes, arranged in rows, of a nest encircling a hollow space in which a cooler for the non-condensable gases is arranged, comprising two nests spaced apart at a distance from one another and to which steam is admitted over their entire periphery, said nests being surrounded by a housing comprising a condenser wall, the nest shape forming an unobstructed convergent flow channel for accelerating the steam and an adjoining unobstructed divergent retaining part for decelerating the steam between the nests and also between one nest each and the condenser wall, and said cooler for the non-condensable cases is located inside a nest.

2. Steam condenser according to claim 1, including a double-flow cooling-water passage, the cooling water is first of all admitted to the tubes opposite a steam inlet of each nest, the cooler for the non-condensable gases preferably being arranged inside the tubes opposite the steam inlet, to which water is admitted first.

3. Steam condenser according to claim 1, wherein the tubes of the cooler in the hollow space of the nest are provided with a cover plate which is designed as a closed suction channel which communicates with the cooler for non-condensable gases via orifices.

4. Steam condenser according to claim 3 wherein the steam-air mixture flowing from the cooler for non-condensable gases into the suction channel is drawn off from the channel via at least one suctionline penetrating through the nest, for which purpose, at a dividing plane where the cooler for non-condensable gases is located between the two flows, one or two tube rows respectively are missing in the nest and are replaced by baffle-like steam barriers.

5. A steam condenser according to claim 1, wherein said cooler for the non-condensable gases is located inside a nest at a level at which a pressure variation in a steam flow lane defined by said convergent flow channel and said divergent retaining part passes through a relative minimum.

* * * * *